US011786802B2

(12) United States Patent
Sitak

(10) Patent No.: US 11,786,802 B2
(45) Date of Patent: Oct. 17, 2023

(54) TRAINING WHEEL FOR SKATEBOARDING

(71) Applicant: Jakub Grzegorz Sitak, Costa Mesa, CA (US)

(72) Inventor: Jakub Grzegorz Sitak, Costa Mesa, CA (US)

( * ) Notice: Subject to any disclaimer, the term of this patent is extended or adjusted under 35 U.S.C. 154(b) by 0 days.

(21) Appl. No.: 17/668,595

(22) Filed: Feb. 10, 2022

(65) Prior Publication Data

US 2023/0001285 A1 Jan. 5, 2023

Related U.S. Application Data

(60) Provisional application No. 63/216,776, filed on Jun. 30, 2021.

(51) Int. Cl.
*A63C 17/01* (2006.01)
*A63C 17/22* (2006.01)

(52) U.S. Cl.
CPC ..... *A63C 17/014* (2013.01); *A63C 17/226* (2013.01)

(58) Field of Classification Search
CPC ..... A63C 17/014; A63C 17/04; A63C 17/226
See application file for complete search history.

(56) References Cited

U.S. PATENT DOCUMENTS

| | | | | |
|---|---|---|---|---|
| 6,419,249 | B1 * | 7/2002 | Chen | A63C 17/0033 16/35 R |
| 6,796,394 | B1 * | 9/2004 | Lin | A63C 17/12 180/181 |
| 7,070,192 | B1 * | 7/2006 | Steiner | A63C 17/26 434/247 |
| 9,120,005 | B2 * | 9/2015 | Hansen | A63C 17/1418 |
| 9,138,633 | B1 * | 9/2015 | Marusiak | A63C 17/014 |
| 2002/0163144 | A1 * | 11/2002 | Guerra | B62H 7/00 280/11.27 |
| 2004/0021281 | A1 * | 2/2004 | Stephens, Jr. | A63C 17/0033 280/87.042 |
| 2008/0157495 | A1 * | 7/2008 | Choi | A63C 17/0033 280/87.042 |
| 2012/0326403 | A1 * | 12/2012 | Lin | A63C 17/014 280/11.27 |
| 2013/0175777 | A1 * | 7/2013 | Bermal | A63C 17/014 280/87.042 |
| 2018/0185738 | A1 * | 7/2018 | Strand | A63C 17/006 |

* cited by examiner

*Primary Examiner* — Brian L Swenson
(74) *Attorney, Agent, or Firm* — Sandy Lipkin

(57) ABSTRACT

The present disclosure provides a detachable training wheel apparatus for mounting to the underside of a skateboard tail or nose to assist with balancing a user during manoeuvres which require tipping of the skateboard onto two wheels, while allowing the board to continue rolling along the ground with minimal friction. The apparatus comprises a single wheel mounted to a mounting board by a pair of supports and a central bushing, with the opposing side of the mounting board having a flat surface provided with attachment means for detachably coupling to the skateboard underside, such as a hook and loop surface.

10 Claims, 4 Drawing Sheets

TRAINING WHEEL FOR SKATEBOARDING

CROSS REFERENCES TO RELATED APPLICATIONS

The present application claims the benefit and priority of US provisional application no. U.S. 63/216,776, filed Jun. 30, 2021.

FIELD OF INVENTION

The present invention relates generally to skateboarding accessories, more specifically the invention relates to a detachable training wheel device for improving a rider's balance while skateboarding on two wheels.

BACKGROUND

In skateboarding it is common to train to perform various tricks, however in the beginning and especially for inexperienced riders balance is often lost, causing the rider to fall from the skateboard and potentially damage it, or get hurt.

One such trick which is notoriously difficult is called a "wheelie/manual", where a rider puts their weight on the very front or back edge of the board, causing the opposing end to lift into the air and allowing the rider to skate on two wheels only for a period of time. This maneuver requires exceptional balance, and even top skateboarders are known to have difficulty with it and are uncomfortable attempting it at times.

Furthermore, when this trick is attempted and fails, usually due to tipping the board too far, the bottom edge of the board inevitably scrapes along the ground, damaging it. Most people lose balance and fall while scraping the board in the process. It is then necessary to start all over again, and many lose confidence and give up on the exercise entirely. Others keep practicing but become too tentative in how they shift their weight and are not able to keep their manual going for extended periods.

While some balancing solutions have been proposed for aiding skateboarders, none are able to solve the aforementioned problems.

U.S. Pat. No. 4,095,817 discloses a device for a wheelie skateboard and consists of a more or less conventional skateboard to which is added a rearward upwardly inclined kicktail. Conventional skateboard wheels are mounted on the bottom of the conventional skateboard section. In this device, a third pair of wheels are mounted on the bottom of the inclined kicktail section. Having an additional pair of wheels limits the possibility of pivoting and changing direction while performing tricks.

U.S. Pat. No. 4,230,330 discloses a skateboard which has a chassis, an axle and wheel assembly, and a board, with the board extending beyond one of the axles to provide an overhanging portion. A stop pad is mounted to the underside of the skateboard in the vicinity of the overhanging portion, said stop pad generally facing the ground when the skateboard is in operational position. Therefore, by shifting weight to the overhanging portion, the rider can tilt the board, causing the stop pad to contact the ground, thereby stopping or at least slowing the skateboard. The board may be rotatably mounted to the chassis, thus allowing the rider to spin in a circle while the skateboard is following a linear course. Stopping the board would however prevent the rider from performing the aforementioned trick.

U.S. Pat. No. 4,199,165 discloses a skid accessory for skateboards adapted to be mounted at the end of the board between the wheel supporting trucks and the end of the board to protect the board from engagement with the ground and to act as a braking device by frictional engagement with the ground. Similarly to the above, the skid accessory would prevent the rider from performing the aforementioned trick.

U.S. Pat. No. 5,165,710 discloses a skateboard device which includes a board of extended surface area adapted to support a skateboard rider, a pair of spaced front and rear wheels connected to the underside of the board, a relatively massive rotor disposed for rotation in a housing connected to the underside of the board adjacent either the rear or front wheels, preferably the rear wheels, and a gear assembly in the housing interconnecting the rotor and wheels which are adjacent thereto. This complicated arrangement needs to be integrated with the skateboard form the beginning and is not detachable.

U.S. Pat. D481,433 discloses a design for a skateboard training device. It does not assist with balancing while performing tricks.

U.S. Pat. No. 7,237,784 B1 discloses an apparatus for a skateboard deck connected to a skateboard carriage by means of a rotative mechanism positioned between the deck and carriage. The carriage is comprised of a platform having the trucks and wheels mounted thereunder with fasteners fixedly positioning a bearing insert and carriage retaining ring to the top side of the platform. This in no way assists the balance of a rider performing tilting tricks.

It is within this context that the present invention is provided.

SUMMARY

The present disclosure provides a detachable training wheel apparatus for mounting to the underside of a skateboard tail or nose to assist with balancing a user during manoeuvres which require tipping of the skateboard onto two wheels, while allowing the board to continue rolling along the ground with minimal friction. The apparatus comprises a single wheel mounted to a mounting board by a pair of supports and a central bushing, with the opposing side of the mounting board having a flat surface provided with attachment means for detachably coupling to the skateboard underside, such as a hook and loop surface.

The apparatus allows for the practice of new skateboard tricks that involve riding on two wheels with minimal risk of the rider falling or of damage to the board, and can be easily removed when no longer needed. It is also simple in its construction and thus easy and cheap to manufacture.

Thus, according to one aspect of the present disclosure there is provided a detachable training wheel apparatus for a skateboard, the apparatus comprising: a mounting board having a first flat surface provided with attachment means for detachably coupling the apparatus to a tail or nose of a skateboard; a pair of wheel supports extending a first length orthogonally from a second opposing surface of the mounting board, each wheel mount having an opening for receiving a screw or pin; a bushing spanning the width between the pair of wheel supports; a single wheel mounted on the bushing; and a pair of screws or pins configured to protrude through the openings in the wheel supports and secure the bushing and mounted wheel to the apparatus.

In some embodiments, the apparatus further comprises a pair of bearing disposed between the pair of wheel supports and the mounted wheel for reducing friction during skating.

In some embodiments, the apparatus further comprises a pair of washers for securing the connection between the pair of screws and the openings of the wheel supports.

In some embodiments, the attachment means comprises a hook and loop surface such as Velcro configured to mate with a corresponding hook and loop surface of an adhesive strip mounted on the underside of a skateboard.

In some embodiments, the openings of the pair of wheel supports are in the from of elongated slots to facilitate adjustment of the distance between the underside of the skateboard and the mounted wheel.

BRIEF DESCRIPTION OF THE DRAWINGS

Various embodiments of the invention are disclosed in the following detailed description and accompanying drawings.

Figure 1:
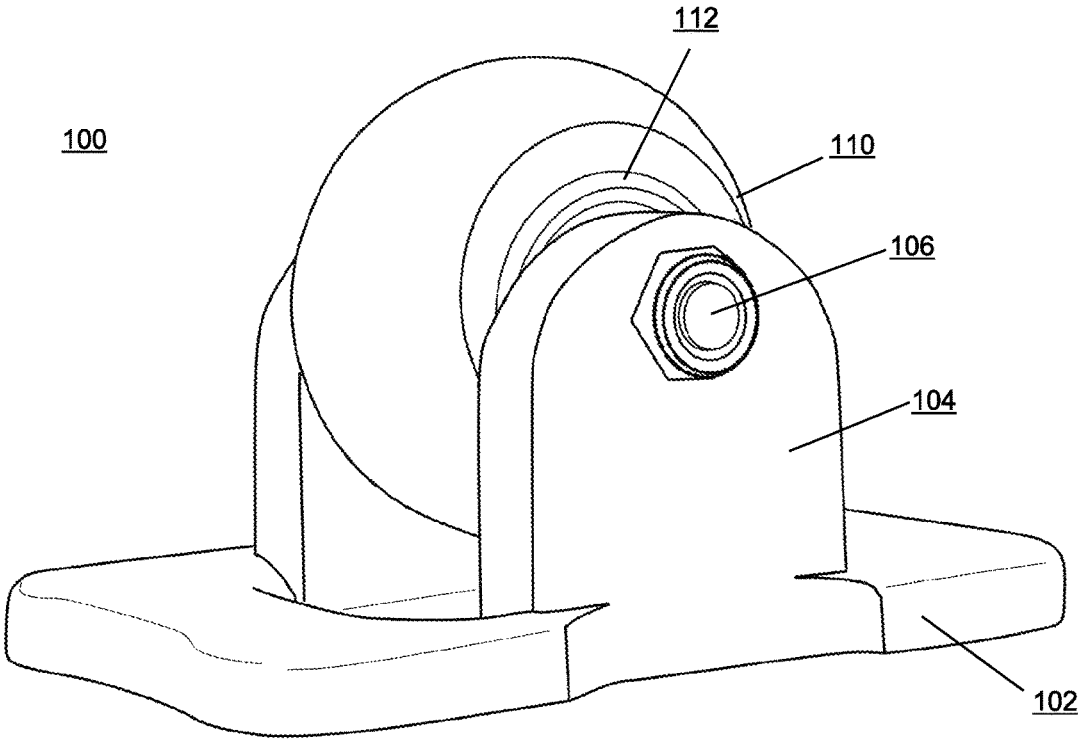
FIG. 1 illustrates a first isometric view of an example configuration of a training wheel apparatus according to the present disclosure.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 2:
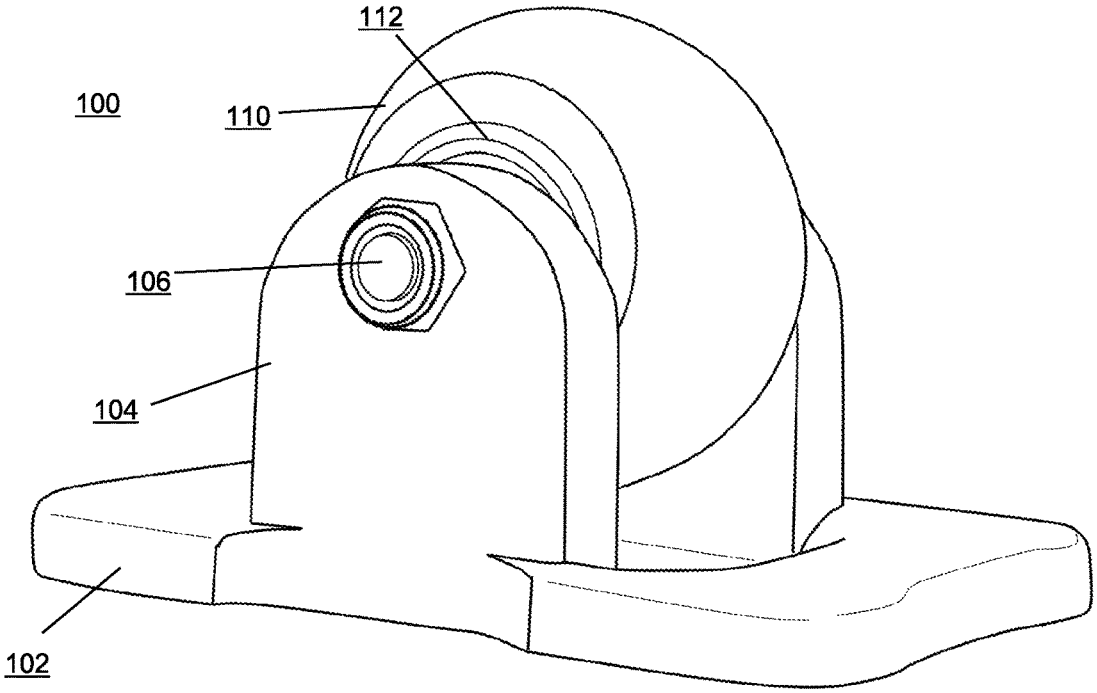
FIG. 2 illustrates a second isometric view of the example configuration of a training wheel apparatus according to the present disclosure.

Referring to FIGS. 1 and 2, first and second views are shown from either side of an example configuration of a training wheel apparatus 100 according to the present disclosure.

As can be seen, the apparatus 100 comprises a flat mounting board 102 from which a pair of wheel supports 104 extend orthogonally. The wheel supports 104 have openings through which a pair of screws 106 secure a central bushing 108 on which a single wheel 110 is mounted. Pins may be used instead of screws 106 in some cases, but screws are preferred as they allow for a more secure coupling with the central bushing 108.

In the present example the wheel 110 is placed between a pair of bearings 112 that prevent friction between the rotating wheel and the wheel supports 104.

The bottom side of the mounting board 102 is provided with attachment means for detachably coupling with the underside of a skateboard tail or nose. In this example the attachment means comprise a layer of hook and loop material such as Velcro, however any suitable attachment means known in the art may be used in place of that.

Figure 3:
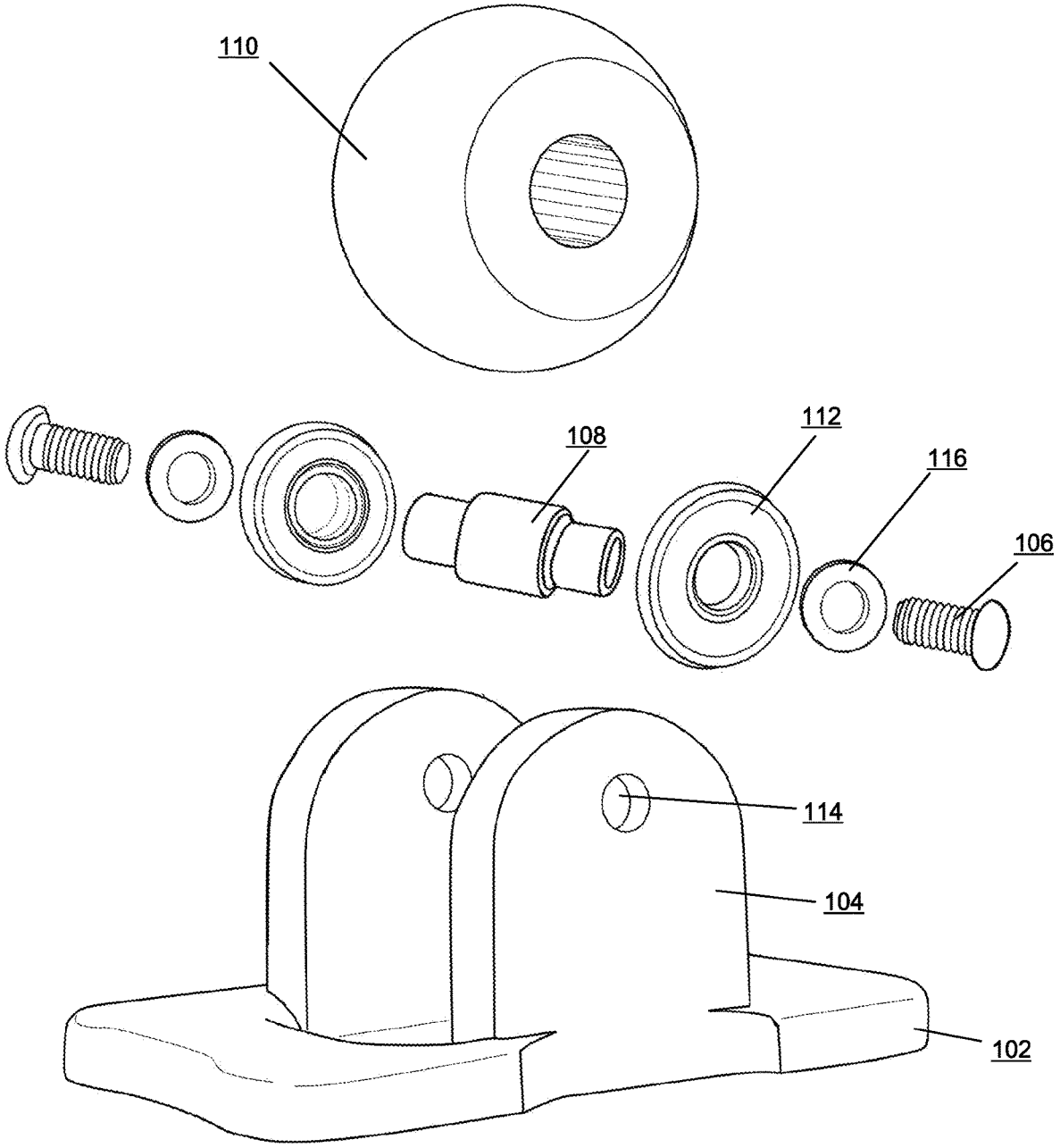
FIG. 3 illustrates an exploded components view of the example configuration of FIGS. 1 and 2.

Referring to FIG. 3, an exploded components view of the example apparatus 100 is shown to give a better picture of the construction.

The openings 114 of the wheel supports are visible in this illustration, and in the present example they are circular in shape and of a similar width to the width of the screws 106. In some alternative embodiments, the openings 114 may be elongated slots and a locking mechanism may be incorporated to allow for the height of the bushing 108 and thus the height of the wheel relative to the skateboard underside to be adjusted.

The central bushing 108 may also have threaded openings either side for coupling ore securely to the screws 106. Washers 116 are placed between the ends of the screws and the outer sides of the wheel supports 104 in the present example configuration to prevent the connections from loosening.

Figure 4C:
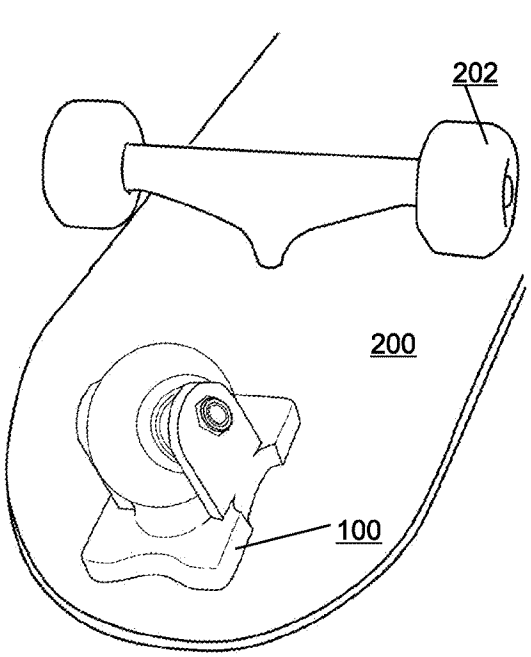
FIGS. 4A, 4B, and 4C illustrate a series of steps in an example method of mounting the disclosed apparatus to the underside of a skateboard tail or nose.
Figure 4B:
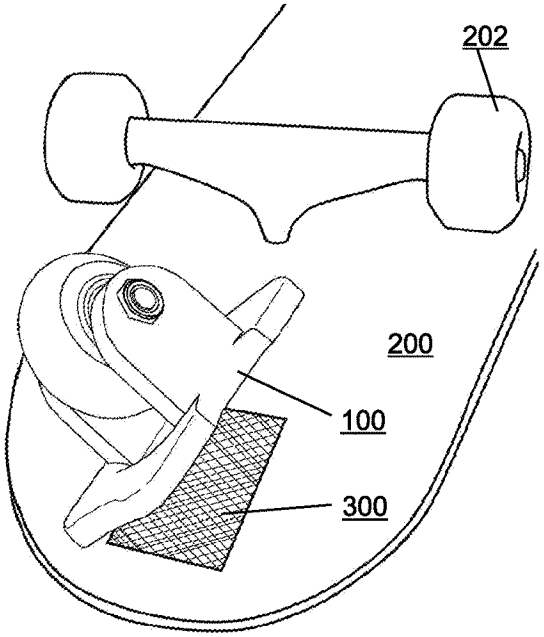
Figure 4A:
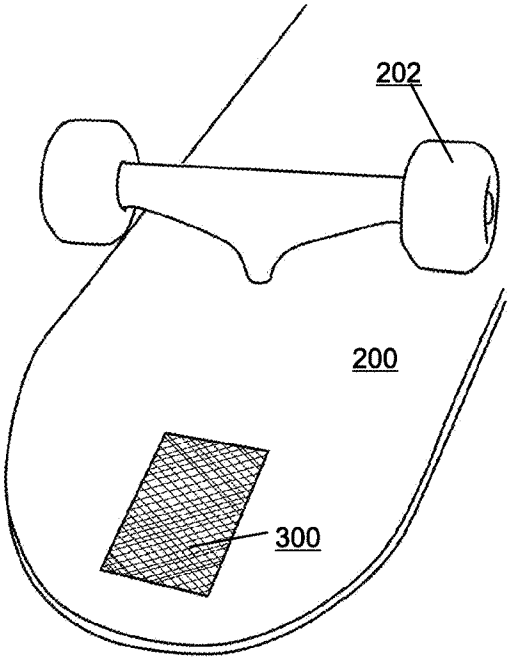

Referring to FIGS. 4A, 4B, and 4C, a series of steps in an example method of mounting the disclosed apparatus 100 to the underside of a skateboard tail or nose 200 is shown, using the above-mentioned hook and loop coupling as the attachment means.

In the first step, shown in FIG. 4A, a first Velcro strip 300 having an adhesive on its rear surface is placed on the tail or nose of the skateboard 200. This Velcro strip acts as a mounting point for the apparatus, which has its own corresponding Velcro strip on the underside of the mounting board 102.

In the second step, shown in FIG. 4B, the apparatus is placed with the mounting board 102 covering the first Velcro strip 300 and such that the mounted training wheel 110 is aligned with the wheels 202 of the skateboard to which it is being mounted. This is important for manoeuvres such as the above described manual trick where a rider will wish to continue rolling along on the two wheels 202, as if they lose balance during that manoeuvre and need to place the training wheel 110 on the ground for balance, the desired effective is that the training wheel 110 will spin in tandem with the wheels 202 of the skateboard, allowing them to keep riding and regain their balance.

Of course, it is also possible to mount the apparatus 100 with a different alignment if desired, and this may be desirable for certain tricks such as aligning the training wheel 110 orthogonally to the skateboard wheels 202 where the rider intends to use the training wheel 110 as support during a rotational pivot of the board.

In the third step, shown in FIG. 4C, the apparatus 100 is pressed firmly against the first Velcro strip 300, coupling the opposing Velcro strip on the underside of the mounting board 102 to it. In order to remove the apparatus, a user simply needs to pull it off.

Figure 5A:
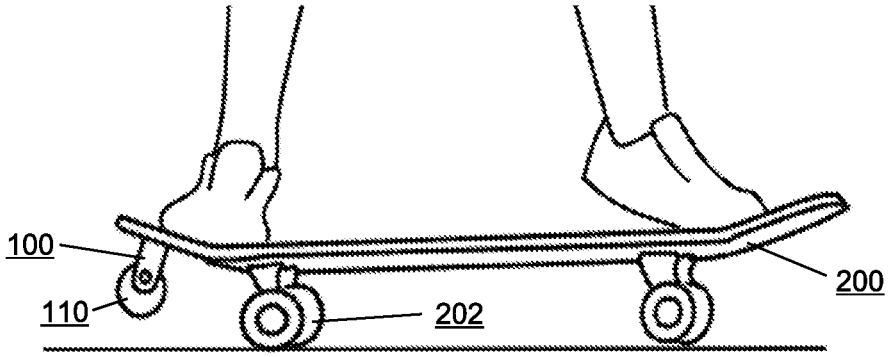
FIGS. 5A, 5B, and 5C illustrate a series of positions of a rider on a skateboard attempting a two-wheeled ride while the disclosed apparatus is mounted to the underside of their skateboard.
Figure 5B:
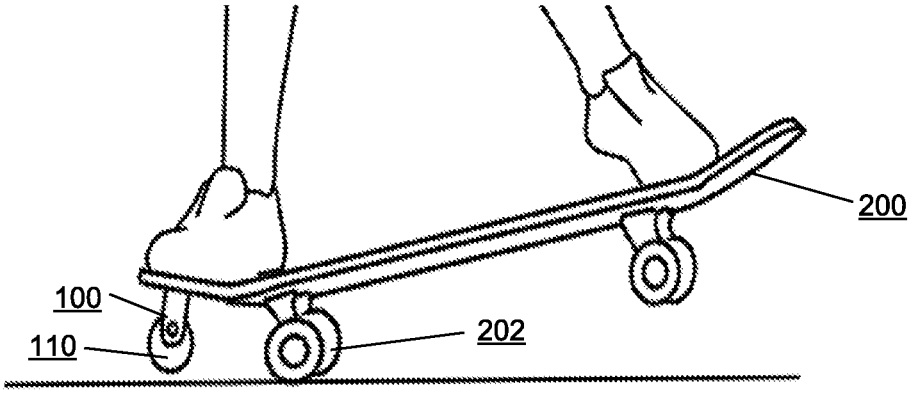
Figure 5C:
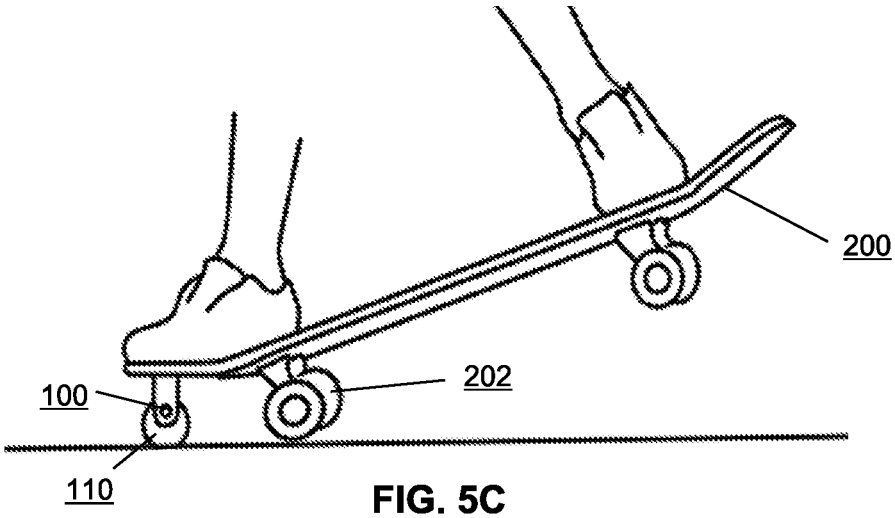

Referring to FIGS. 5A, 5B, and 5C, a series of positions are shown of a rider on a skateboard attempting a two-wheeled ride while the disclosed apparatus 100 is mounted to the underside of their skateboard 200.

The training wheel 110 is mounted in alignment with the wheels 202 of the skateboard for this exercise.

In the first position, shown in FIG. 5A, the rider is moving forwards with their weight centred and both pairs of skateboard wheels 202 firmly on the ground. The training wheel apparatus 100 is mounted on the underside of the rear tail or nose of the board 200.

In the second position, shown in FIG. 5B, the rider shifts their weight to the back of the board, causing the front end to rise into the air while they attempt to balance and continue riding on the two rear wheels 202 alone. This stage, often called the "sweet spot", is where it is easy to shift one's weight too far and where a rider would thus often scrape the rear tail or nose of the board along the ground and lose their balance, falling off the board.

In the third position, shown in FIG. 5B, the rider has shifted their weight too far, but this has simply caused the training wheel 110 to come into contact with the ground, preventing the board 200 from tipping further back. The training wheel 110 rolls smoothly along in tandem with the two rear skateboard wheels 202, allowing a rider to continue forwards and find their balance again without falling off. Optionally, they can attempt to shift their weight slightly forwards again and find the sweet spot now that they have gotten a feeling for the balance of it.

Being able to practice without the fear of falling and damaging the board allows a person to progress much faster in the process of learning balancing while riding on two wheels. This device allows skateboarders to learn balance while in both forward and backward motion, and if the wheel is aligned orthogonally to the skateboard wheels, also while spinning in circles. The apparatus has a wide range of use cases for anyone looking to take their skills to the next level in a safe manner, regardless of age and riding abilities.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the training wheel apparatus have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A detachable training wheel apparatus for a skateboard to provide balance training to a rider, the apparatus comprising:

a mounting board having a first flat surface provided with attachment means for detachably coupling the apparatus between one of a pair of wheels under a skateboard and a tail or nose of a skateboard such that said apparatus is positioned between said one of a pair of wheels and said tail or nose toward an outer edge of said skateboard;

a pair of wheel supports extending a first length orthogonally from a second opposing surface of the mounting board, each wheel mount having an opening for receiving a screw or pin;

a bushing spanning the width between the pair of wheel supports;

a single wheel mounted on the bushing; and a pair of screws or pins configured to protrude through the openings in the wheel supports and secure the bushing and mounted wheel to the apparatus.

2. A training wheel apparatus according to claim 1, wherein the apparatus further comprises a pair of bearing disposed between the pair of wheel supports and the mounted wheel for reducing friction during skating.

3. A training wheel apparatus according to claim 1, wherein the apparatus further comprises a pair of washers for securing the connection between the pair of screws and the openings of the wheel supports.

4. A training wheel apparatus according to claim 1, wherein the attachment means comprises a hook and loop surface such as Velcro configured to mate with a corresponding hook and loop surface of an adhesive strip mounted on the underside of the skateboard.

5. A training wheel apparatus according to claim 1, wherein the openings of the pair of wheel supports are in the form of elongated slots to facilitate adjustment of the distance between the underside of the skateboard and the mounted wheel.

6. A method of providing training to provide balance training for a rider comprising the steps of:

acquiring a skateboard, said skateboard further comprising:

a deck with a first end (nose), a second (tail), a top side and a bottom side;

a first set of wheels on said bottom side proximate said first end (nose) with a first reserved space between said first set of wheels and said first end (nose);

a second set of wheels on said bottom side proximate said second end (tail) with a second reserved space between said second set of wheels and said second end (tail);

affixing a training wheel in one or both said first reserved space and second reserved space, said training wheel further comprising:

a mounting board having a first flat surface provided with attachment means for detachably coupling said training wheel to either or both of said first and second reserved spaces;

a pair of wheel supports extending a first length orthogonally from a second opposing surface of the mounting board, each wheel mount having an opening for receiving a screw or pin;

a bushing spanning the width between the pair of wheel supports;

a single wheel mounted on the bushing; and a pair of screws or pins configured to protrude through the openings in the wheel supports and secure the bushing and mounted wheel to the apparatus;

training for balance on said skateboard with said training wheel attached; and detaching said training wheel once balance has been mastered.

7. The method according to claim 6, wherein said training wheel further comprises a pair of bearing disposed between the pair of wheel supports and the mounted wheel for reducing friction during skating.

8. The method according to claim 6, wherein said training wheel further comprises a pair of washers for securing the connection between the pair of screws and the openings of the wheel supports.

9. The method according to claim 6, wherein the attachment means comprises a hook and loop surface such as Velcro configured to mate with a corresponding hook and loop surface of an adhesive strip mounted on the underside of the skateboard.

10. The method according to claim 6, wherein the openings of the pair of wheel supports are in the form of elongated slots to facilitate adjustment of the distance between the underside of the skateboard and the mounted wheel.

* * * * *